US005647100A

United States Patent [19]

Porchia et al.

[11] Patent Number: 5,647,100

[45] Date of Patent: Jul. 15, 1997

[54] CLOSURE MEMBER FOR A RECLOSABLE THERMOPLASTIC BAG

[75] Inventors: Jose Porchia, Midland; Brian C. Dais, Sanford, both of Mich.

[73] Assignee: Dowbrands L.P., Indianapolis, Ind.

[21] Appl. No.: 521,149

[22] Filed: Aug. 29, 1995

Related U.S. Application Data

[63] Continuation-in-part of Ser. No. 403,993, Mar. 14, 1995.

[51] Int. Cl.[6] ..... A44B 17/00

[52] U.S. Cl. ..... 24/30.5 R; 24/587; 24/576; 383/63

[58] Field of Search ..... 383/63–66; 24/30.5 R, 24/587, 575–577, 399, 400

[56] References Cited

U.S. PATENT DOCUMENTS

| | | | |
|---|---|---|---|
| Re. 28,969 | 9/1976 | Naito | 24/587 X |
| 2,035,028 | 3/1936 | Temple . | |
| 2,144,755 | 1/1939 | Freedman . | |
| 4,363,345 | 12/1982 | Scheibner | 383/63 |
| 4,528,224 | 7/1985 | Ausnit | 383/63 X |
| 4,561,109 | 12/1985 | Herrington | 24/587 X |
| 4,736,496 | 4/1988 | Fisher et al. | 24/587 |
| 4,829,641 | 5/1989 | Williams | 24/587 |
| 5,007,146 | 4/1991 | Meidan | 24/587 X |
| 5,070,584 | 12/1991 | Dais et al. | 24/587 |
| 5,138,750 | 8/1992 | Gundlach et al. | 24/587 |
| 5,140,727 | 8/1992 | Dais et al. | 24/587 |
| 5,154,086 | 10/1992 | Porchia et al. | 73/818 |
| 5,187,843 | 2/1993 | Lynch | 24/576 |
| 5,356,222 | 10/1994 | Kettner et al. | 24/587 X |
| 5,385,251 | 1/1995 | Dunn | 383/63 X |
| 5,403,094 | 4/1995 | Tomic | 24/587 X |

FOREIGN PATENT DOCUMENTS

| | | | |
|---|---|---|---|
| 720377 | 12/1954 | Australia . | |
| 514547 | 6/1954 | Belgium | 24/587 |
| 764647 | 8/1967 | Canada | 24/587 |
| 0130602A1 | 6/1984 | European Pat. Off. . | |
| 0279599A1 | 2/1988 | European Pat. Off. . | |
| 0 446 760 A1 | 9/1991 | European Pat. Off. . | |
| 0 510 797 A1 | 10/1992 | European Pat. Off. . | |

*Primary Examiner*—Peter M. Cuomo
*Assistant Examiner*—Robert J. Sandy

[57] ABSTRACT

A closure member for a reclosable thermoplastic bag having opposing rib and groove profiles wherein the rib profile has an longitudinally extending part interlockable and substantially free of interdigitation with the opposing groove profile and wherein the part is deformed defining indentions in the part to provide structural discontinuity along its length. When the rib and groove profiles are interlocked, an audible clicking sound and/or a vibratory or bumpy feel perceptible to the touch is imparted.

13 Claims, 9 Drawing Sheets

Fig. A
(PRIOR ART)
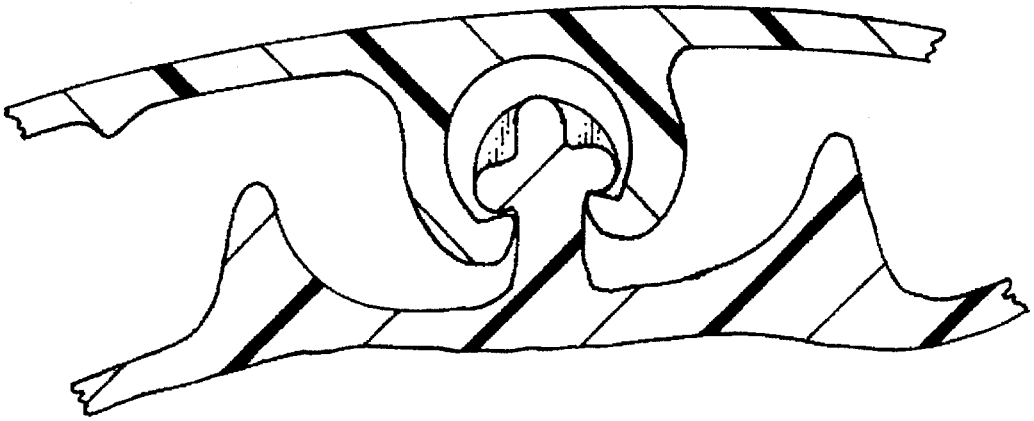
Fig. 11
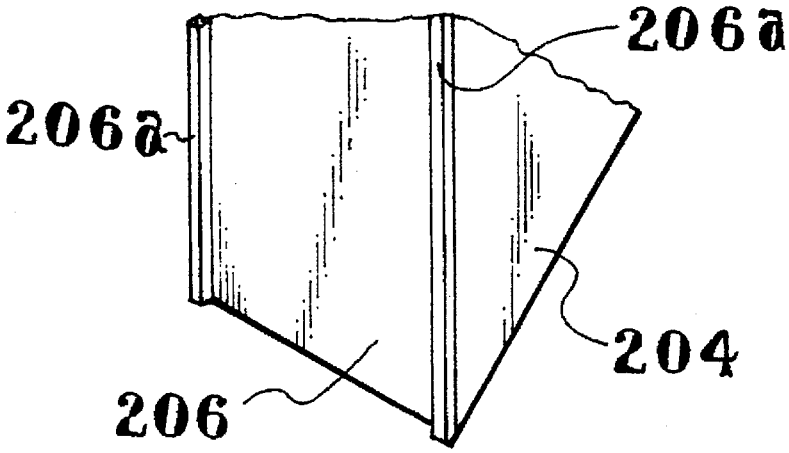

CLOSURE MEMBER FOR A RECLOSABLE THERMOPLASTIC BAG

CROSS-REFERENCE TO RELATED APPLICATION

This application is a Continuation-in-Part of the copending application Ser. No. 08/403,993, filed Mar. 14, 1995.

BACKGROUND OF THE INVENTION

This invention relates to a closure member for a reclosable thermoplastic bag wherein the closure member creates a clicking noise when the closure member is being opened or closed and to a reclosable thermoplastic bag having the closure member. Further, the closure member imparts a vibration or bumpy feel which is tactile and readily perceptible to the touch when the closure member is closed.

In particular, the present invention is concerned with reclosable zippers and thermoplastic zippered bags of the type described in commonly-assigned U.S. Pat. No. 5,070,584 (the '584 patent), such patent being hereby incorporated herein by reference.

The '584 patent discloses a zipper for a reclosable thermoplastic bag having opposing rib and groove profiles wherein at least one of the opposing zipper profiles has a longitudinally extending part interlockable and substantially free of interdigitation with the opposing profile and wherein the part is structurally discontinuous along its length. When the rib and groove profiles are interlocked, an audible clicking sound and/or a vibratory or bumpy feel perceptible to the touch is imparted.

The bags described in the '584 patent provide confirmation of their closure by producing a distinctive tactile and/or audible indication of the interlocking of the male and female profiles in their zippers. This tactile and/or audible indication of the proper interlocking of the male and female profiles is produced by varying the closure force required to interlock the male and female profiles over the length of the zipper. Typically the closure force is cycled intermittently over the length of the zipper between a low closure force and a high closure force, with the changes in closure force being produced in turn by making one or both of the profiles intermittently structurally discontinuous. These intermittent structural discontinuities are manifest in the form of first and second differently-shaped segments over the length of a profile part interlockable with the opposing profile. The differently-shaped segments interlock differently with corresponding portions of the opposing profile and implicate different closure forces.

The magnitude of force required to interlock the male and female profiles of a zippered bag is important to consumers since the forces required to close or zip a zipper in reclosable thermoplastic zippered bags must be low enough to be easy to close the bag and provide the user of the bags a degree of certainty or assurance of closure given by the zippers in such bags and yet the closing force should not be so high that it would be difficult to close or zip the bag.

The zipper profiles disclosed in the '584 patent have worked tremendously well in thermoplastic bags of the prior art and have adequately addressed the problem pertaining to the determination of closure or nonclosure of the zipper of a reclosable bag which such determination is often difficult save with a close visual examination. Prior to the invention of the '584 patent, closure members on reclosable bags did not impart a vibratory or bumpy feel or impart audible clicking sounds along its length between the ends of the closure member as it is being closed or interlocked.

There still exists a need for alternative and improved thermoplastic closure members that impart a vibration perceptible to the touch, and emanate an audible clicking sound along the closure member's length when being closed or interlocked so that the fact of closure can be confirmed by a nonvisual means, i.e., by sound and feel.

Accordingly, it is desired to provide a reclosable bag having an improved closure member that imparts a vibration perceptible to the touch, and, further preferably, emanates an audible clicking sound continually along the closure member from end to end; and it is desired to provide a reclosable bag having a closure member having a low average closing force while still maintaining the bag's integrity, i.e., the high burst strength of the bag.

SUMMARY OF THE INVENTION

One aspect of the present invention is directed to a closure member for a reclosable thermoplastic bag having two opposing, longitudinally extending interlockable profiles wherein at least one of the profiles has a longitudinally extending part interlockable with the opposing profile wherein the part is substantially free of interdigitation with the profile and wherein the part has indentions within and intermittently along its length.

The indentions form a raised portion intermittently along the length of the profile such that the palmograph value of the closure is increased and the closing force of the closure is decreased. "Palmograph Value" herein means a measure of vibratory feel of a user of the closure.

In a preferred embodiment of the present invention, the part defines a first segment and a second segment along its length. The segments differ in shape. The closure member preferably imparts a vibratory or bumpy feel perceptible to the touch when the profiles are interlocked along its length. The closure member also preferably imparts an audible clicking sound continually along its length when the profiles are interlocked or separated.

One embodiment of the closure member includes interlocking rib and groove profile elements.

Another aspect of the present invention is directed to a reclosable thermoplastic bag having the aforementioned closure member.

Still another aspect of the present invention is directed to an apparatus for making the aforementioned longitudinally extending closure member for a thermoplastic reclosable bag. One embodiment of the apparatus includes a means for providing a first closure member rib profile having a longitudinally extending part interlockable with a longitudinally extending opposing second closure member groove profile; a means for deforming the part to form indentions therein intermittently along its length such that when the profiles are interlocked the indentions within the part are substantially free of interdigitation with portions of the second profile; and a means for providing the second closure member profile.

Another aspect of the present invention is directed to a process for making the aforementioned longitudinally extending closure member for a thermoplastic reclosable bag. One embodiment of the process includes the steps of providing a first closure member rib profile having a longitudinally extending part interlockable with a longitudinally extending opposing second closure member profile; deforming portions of the part to form indentions therein intermittently along its length such that when the profiles are interlocked the indentions within the part are substantially free of interdigitation with portions of the second profile; and providing the second closure member profile.

Still another aspect of the present invention is directed to a process for making a thermoplastic reclosable bag having the aforementioned closure member. One embodiment of the process includes the steps of attaching the aforementioned closure member to the opening of a thermoplastic bag.

BRIEF DESCRIPTION OF THE INVENTION

The novel features of the present invention and the context within which they are set will be better understood upon reviewing the following specification together with the several drawings in which the same reference numbers are employed for the same parts in the various views and wherein:

FIG. 8 is an enlarged fragmentary perspective view of an embodiment of a deforming apparatus according to the present invention wherein a closure member rib profile is being processed therethrough.

FIG. 11 is greatly enlarged fragmentary perspective view of a single teeth element of a rotary member of a deforming apparatus.

Figure 12:
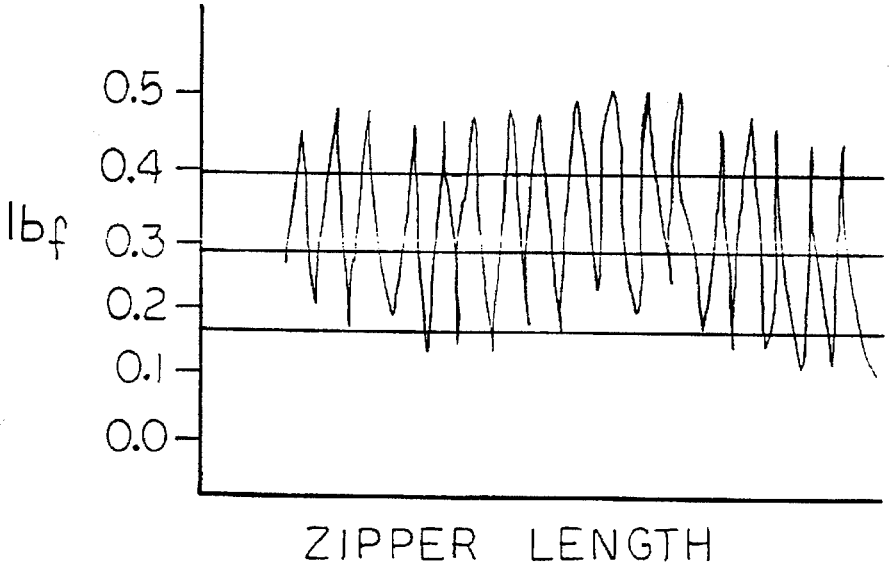

FIG. 12 is a typical graphical representation of the closure forces measured by an apparatus shown and described in U.S. Pat. No. 5,154,086 in the testing of a zipper of the type shown and described in U.S. Pat. No. 5,070,584.

Figure 13:
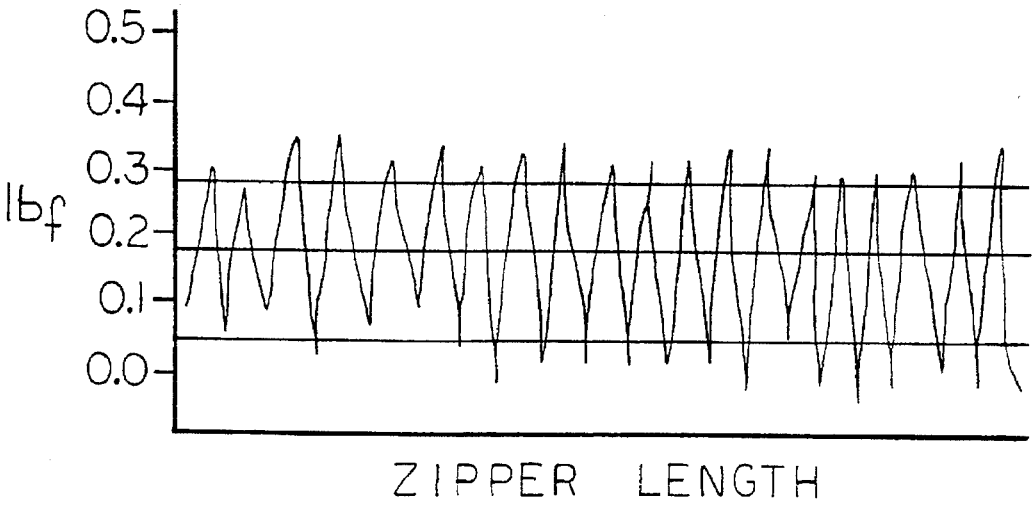

FIG. 13 is a typical graphical representation of the closure forces measured by an apparatus shown and described in U.S. Pat. No. 5,154,086 in the testing of a closure member of the present invention.

Figure 14:
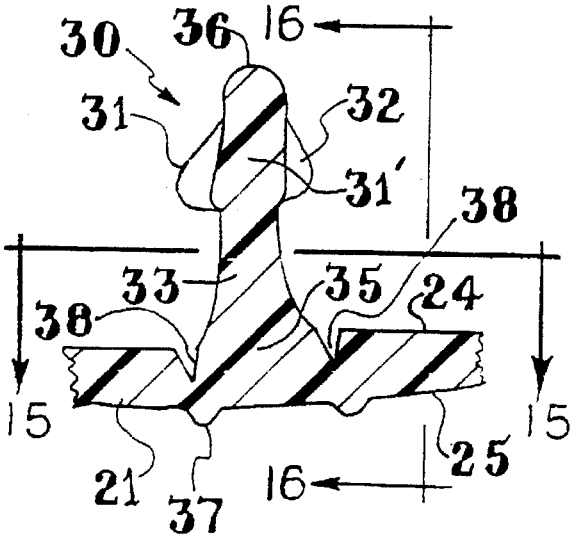

FIG. 14 is an enlarged cross-sectional view of another embodiment of a closure member of the present invention.

Figure 15:
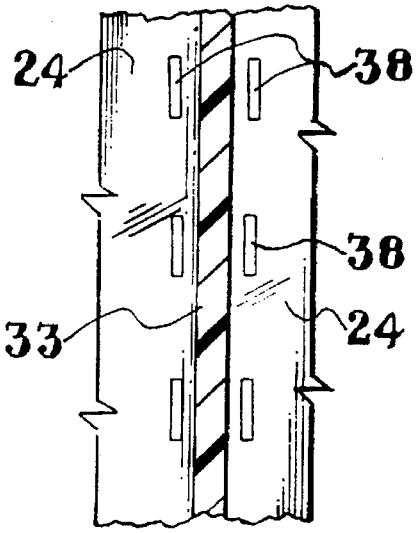

FIG. 15 is a fragmentary partly cross-sectional, partly elevational view taken along line 15—15 of FIG. 14 showing the indentions on the top surface of the sidewall of a reclosable thermoplastic bag at the base of the closure member of the present invention.

Figure 16:
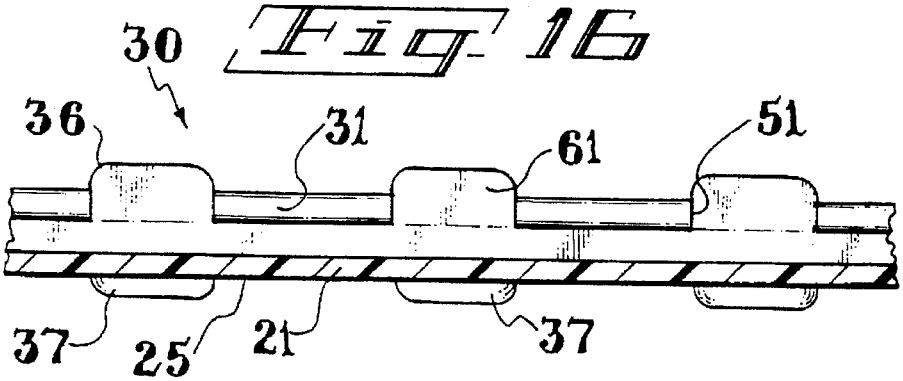

FIG. 16 is an enlarged partly cross-sectional, side view taken along line 16—16 of FIG. 14.

Figure 17:
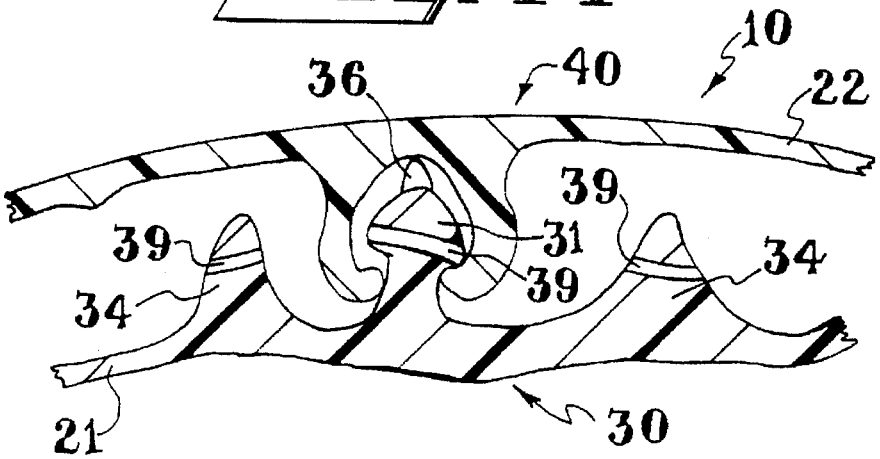

FIG. 17 is an enlarged cross-sectional view another embodiment of a closure member of the present invention wherein the closure member has regimes of colored thermoplastic material in the rib profile including the head and rib members.

FIGS. 18 to 21 are enlarged cross-sectional views of different embodiments of the closure member of the present invention showing the deformed portions of the profiles.

Figure A is an enlarged cross-sectional view of a zipper of the type shown and described in U.S. Pat. No. 5,070,584.

DETAILED DESCRIPTION OF PREFERRED EMBODIMENTS

In general, the closure member of the present invention has two opposing longitudinally extending interlockable profile elements wherein at least one of the profile elements has intermittent deformations or indentions along the profile's length forming a raised portion intermittently along the longitudinal length of the profile. Generally, the indentions are smaller than the original profile, for example, the indentions are narrower in width and taller in height than the originally formed profile. Such indentions advantageously increase the palmograph value and decrease the closing force of the closure member.

Several embodiments of the profile elements are described hereinbelow which can be attached near the mouth or opening of a thermoplastic bag member having overlaying sidewalls. The various profile elements may be produced separately and subsequently attached to the respective sidewalls of the bag near the bag mouth or the profile elements may be produced integral with the sidewalls of the bag.

Figure 1:
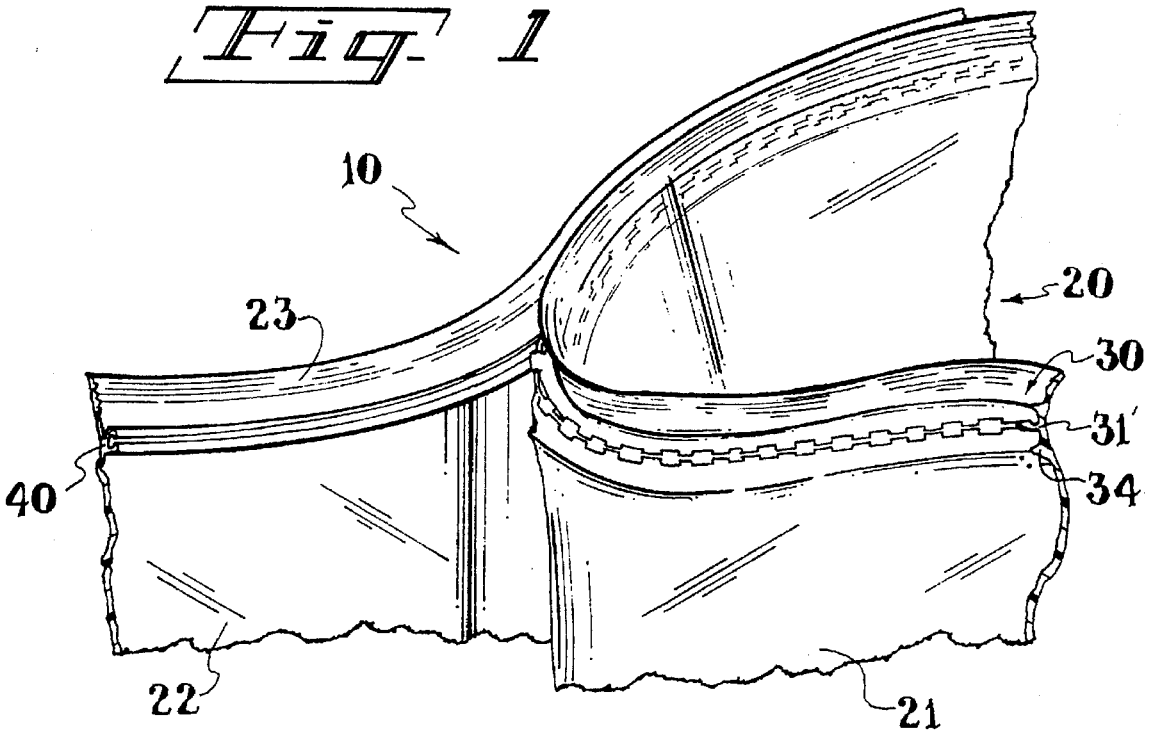
FIG. 1 is an enlarged, fractional perspective view of a reclosable thermoplastic bag having a reclosable closure member in accordance with the present invention.
Figure 1A:
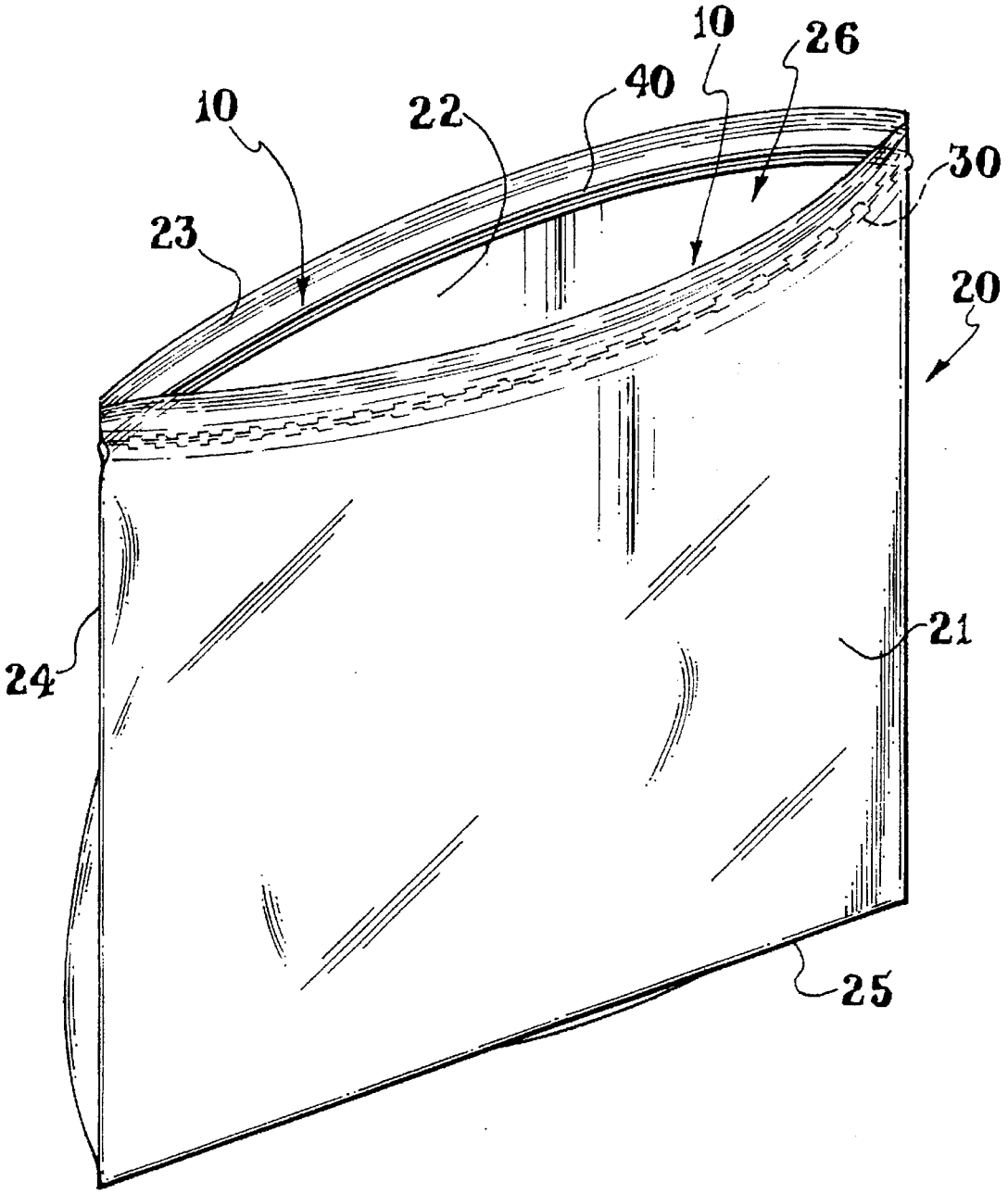
FIG. 1A is a perspective view showing an opened reclosable thermoplastic bag having a reclosable closure member of the present invention.

FIGS. 1 and 1A shows one embodiment of a closure member generally indicated as numeral 10 and a thermoplastic bag generally indicated as numeral 20 constructed in accordance with the present invention.

The bag or bag body 20 comprises a sidewall 21 overlaying a second sidewall 22. The sidewalls 21 and 22 are attached along opposite longitudinal heat seal edges 24 and a bottom fold line 25, thereby forming an open mouth 26 adjacent to the top edge of the bag 20. The bag 20 has the closure member 10 comprising, in this instance, reclosable interlocking profile elements 30 and 40 secured throughout the length thereof to the respective sidewalls 21 and 22 of the bag near the top edge opening of the bag. The profile elements 30 and 40 may be extruded separately and subsequently attached to the respective sidewalls of the bag near the bag mouth or the profile elements may be extruded integral with the sidewalls of the bag. The bag 20 may be made from any suitable thermoplastic film such as for example polyethylene or polypropylene or equivalent materials. The bag 20 is preferably made out of a plastic film such as polyethylene. The various embodiments of the closure member 10 are shown in more detail in FIGS. 2 to 8.

Referring to FIG. 1 again, there is illustrated a closure member 10 for a reclosable thermoplastic bag 20. Closure member 10 is preferably continuous in length across the opening at the top of bag 20. Closure member 10 is comprised of a thermoplastic material, and can be comprised of the same or different material as the remainder of bag 20. Any suitable thermoplastic film for example polyethylene or polypropylene or equivalent material can be used in making the closure member 10 and bag 20 of the present invention. The closure member 10 is made up of a male and female type profile mounted on and positioned on the inside surface of the sidewalls 21 and 22 of the bag near the mouth of the bag 20 and extend transversely across the full longitudinal width of the opening of the bag. A surface 23 or lip above the closure member 10 is provided for gripping by a user.

The open mouth 26 of the bag provides access to the interior of the bag. Closure of the bag 20 is effected by contacting the sidewalls at the closure member applying pressure along the area where the closure member is located, thus closing the bag by pressing or meshing the profiles together. The sidewalls 21 and 22 are joined together to enclose the bag 20. When desired to open the bag, the sidewalls may be grasped at the gripping surface 23 and pulled apart. The closure member 10 may be pressed and pulled apart many times to easily open (and reopen) and close the bag opening.

Generally, closure member 10 comprises opposing, longitudinally extending interlockable rib and groove profiles (closure member profiles 30 and 40, respectively). The rib profile 30 has indentions within and intermittently along its length preferably along a surface of the rib profile adjacent a portion of the opposing groove profile 40. Preferably, the indentions are present in and along a part of the rib profile interlockable with a part of the opposing closure member groove profile wherein both of the interlockable parts are longitudinally extending. Further preferably, the indentions and the surfaces which define or bound the indentions of the part of the closure member rib profile are adjacent the part of the opposing closure member groove profile with which it is interlocked. Further preferably, the part of the closure member rib profile having indentions therein is substantially free of interdigitation with the part of the opposing closure member groove profile with which it is interlockable.

Being substantially free of interdigitation means that the cavities defined by the indentions within the part are substantially free of intrusion by portions of the part of the opposing profile. Being substantially free of interdigitation can be advantageous because the opposing profiles can be more easily interlocked because the opposing structures along the profiles need not be mated and matched to as significant a degree. The presence of indentions within a profile or part thereof results in the profile or part thereof being structurally discontinuous along its length and having at least two different segments along it wherein the segments are different in shape. Preferably, the profile or part thereof has two different or first and second segments which alternate along the entire length of the profile. Thus, the shape of the profile or part thereof alternates between two different shapes segmentally along the profile. Preferably, the rib profile 30 or parts thereof may have segments of differing shape.

More specifically, one preferred embodiment of the closure member 10 in accordance with the present invention, illustrated in FIGS. 2–8, comprises opposing, essentially continuous longitudinally extending interlockable male and female profile elements in the form of rib profile 30 and groove profile 40, respectively. Rib profile 30 is seen in fragmentary isolation in FIG. 6.

The rib profile 30 is preferably deformed at spaced intervals along the length of the rib profile providing undeformed segments 50 and deformed segments 60 along the length of the rib profile to provide an intermittent clicking sensation as the rib and groove profiles are pressed into interlocking relation along the length of the profile elements to close the reclosable closure member 10 thereby providing confirmation by sound and/or touch to the user that the closure member 10 is closed.

Viewing FIGS. 2–8, rib profile 30 when in an undeformed configuration in segment 50 defines a bulbous head 31 generally triangularly-shaped (or arrow-shaped) in cross-section with extending hooks or ear portions 32, and a stem 33. The term "bulbous" in this specification includes not only round but also generally arrow-like or triangular-shaped as is commonly seen in the prior art. For example, rib and groove type interlocking profile elements that can be closed by pressing the elements together, is shown in U.S. Pat. No. Re. 28,969.

Figure 10:
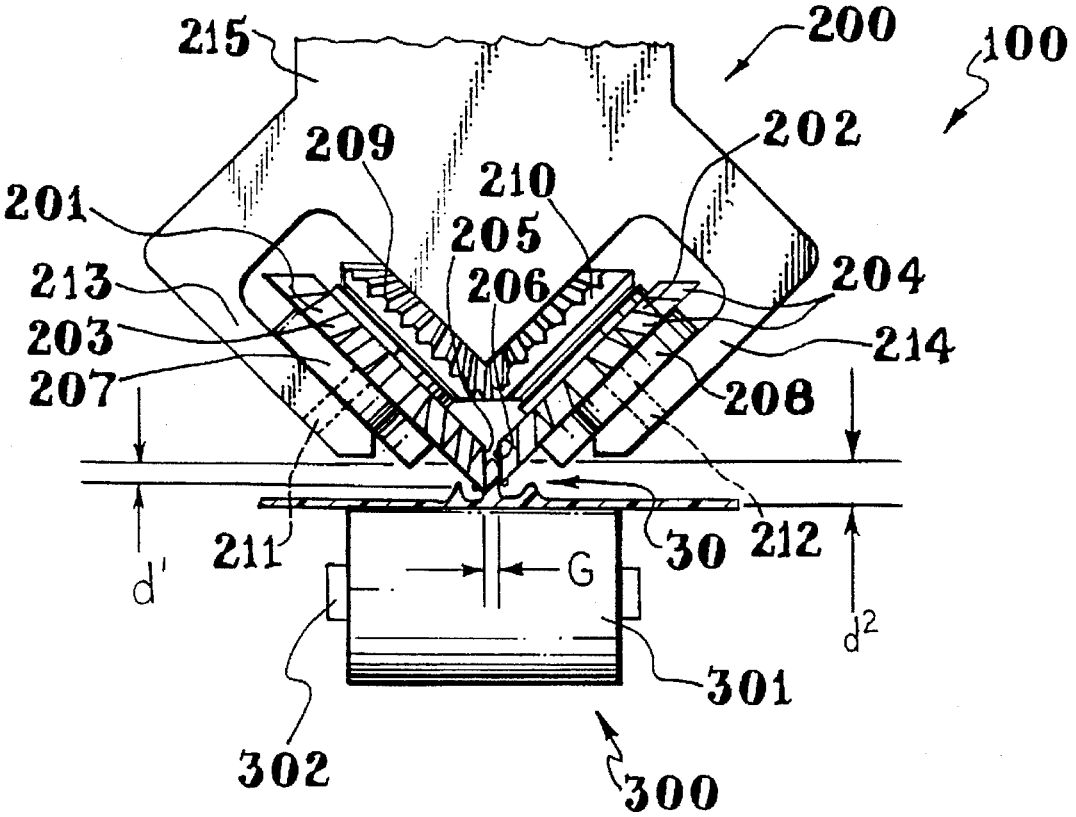
FIG. 10 is an enlarged fragmentary top view of the deforming apparatus of FIG. 8.

Optionally and preferably, one or more ribs 34 (as shown in FIGS. 1, 10 and 16) adjacent stem 33 can be formed on one or both sides of the stem 33. The ribs 34 can be of the type, for example, as shown and described in U.S. Pat. No. 4,736,496, incorporated herein by reference. One or more of the ribs 34 may be deformed at spaced intervals along the length of the rib 34 similar to the rib profile 30 as described below with respect to FIG. 18. Stem 33 is essentially continuous, and longitudinally extend along profile 30. Head 31 is essentially continual, and longitudinally extends intermittently and preferably alternately along profile 30 resulting in structural discontinuity along profile 30.

Referring to FIGS. 2–8 again, rib profile 30 when in a deformed configuration in segment 60 defines a compressed elongated head 31' missing the extending hooks or ears 32 shown in head 31, and a stem 33, i.e., in segment 50, head 31 has outwardly extending hooks 32 whereas in segment 60 head 31' has no such hooks. Indentions within segments 60 are manifest by the lack of upper laterally-disposed hooks or ear portions of head 31' in segments 60. The upper laterally-disposed hooks or ear portions 32 of head 31 are those which are present in head 31 in segment 50 but not segment 60.

Segments 50 and head 31 have surfaces 51, which are preferably generally planar and perpendicular to the longitudinal extension of head 31 and head 31'. Segments 60 define surfaces 61 which are preferably generally planar and parallel to the longitudinal extension of head 31 and head 31'. Planar surface 61 is positioned perpendicular to surfaces 51 and at about right angles with respect to each of the surfaces 51. The indention in segment 60 further includes the base generally planar surface 24 which is also perpendicular to the surfaces 51 and 61 at about right angles.

The base surface 24 is the top surface of the film sidewall member 21. Rib profile 30 defines alternating first segments 50 and second segments 60 along its length. Segments 50 and 60 have different shapes by virtue of the differing shapes of head 31 and 31' resulting in a structural discontinuity along profile 30. In segments 60, an elongated shank-shaped member is defined by stem 33 which extends from rib base 35 to head 31', head 31' and a raised ridge head portion 36 at the free end of the shank-shaped member. In segment 50, head 31 includes oppositely disposed outwardly extending hooks 32.

Groove profile 40 defines groove arms 41. Head 31 constitutes a longitudinally extending part of profile 30 interlockable with an essentially continuous and longitudinally extending part of profile 40 constituting groove arms 41. Groove arms 41 straddle head 31 when profiles 30 and 40 are interlocked, and define hooks 42 which engage and are interlockingly coextensive with the hooks 32 of head 31.

Figure 18:
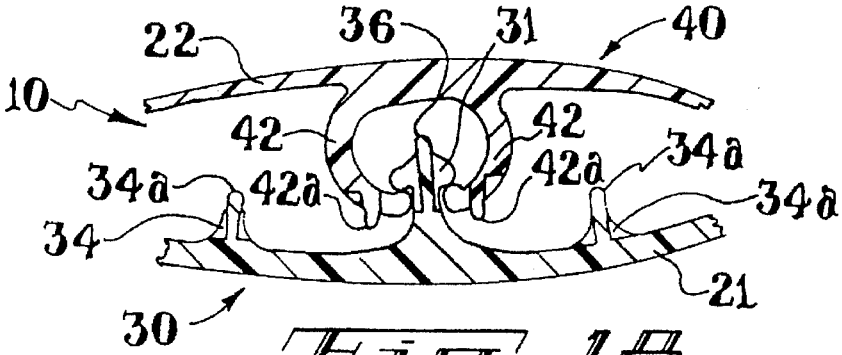

Preferably, the indentions within segments 60 are substantially free of interdigitation by portions of groove arms 41. It is contemplated that the scope of the present invention includes a groove profile 40 having deformed hooks 42 as shown in FIG. 18 hereinbelow.

In a preferred embodiment of the present invention, shown in FIGS. 2 to 8 inclusive, the closure member or zipper 10, is comprised of conventional rib- and groove-type male and female profiles 30 and 40 respectively, with the head portion 31 above the stem portion 33 of the male rib profile 30 having been intermittently mechanically deformed to possess a generally elongated shank-shaped cross-section in segments 60 of the profile 30. Thus, the male profile in the deformed segments 60 defines a generally elongated vertically extending shank-shaped member made up of head 31', stem portion 33 and an extended or raised ridge head portion 36. The male profile in these deformed segments 60 do not interact with the hooks 42 of the female groove-type profile 40 as do the ears or hook portions 32 of the undeformed head portion 31. The segments 50 having the undeformed head 31 require a different closure force than those segments 60 of the male profile 30 having a deformed head 31'.

Figure 2:
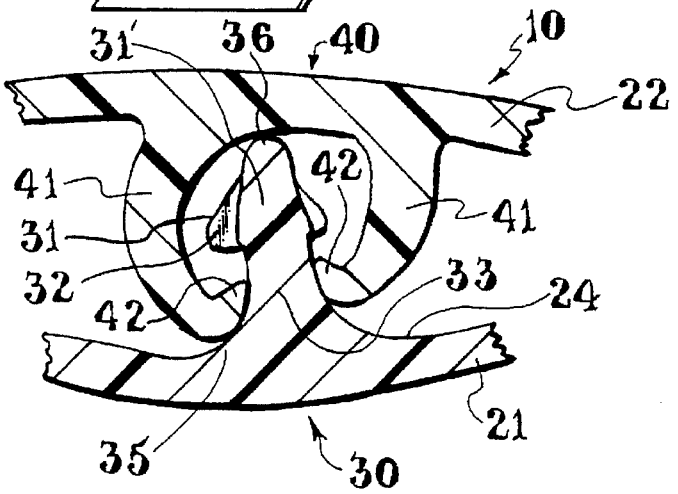
FIG. 2 is an enlarged cross-sectional view of an embodiment of the closure member of the present invention having a groove profile and a rib profile, the rib profile having a head and a stem portion, the rib profile being intermittently deformed at the head of the rib profile, showing a cross-section of the deformed portion of the rib profile.
Figure 3:
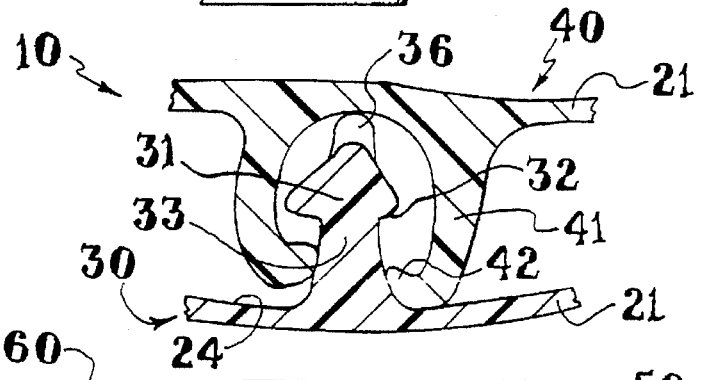
FIG. 3 is another enlarged cross-sectional view of an embodiment of the closure member of the present invention having a groove profile and a rib profile, the rib profile having a head and a stem portion, the rib profile being intermittently deformed at the head of the rib profile, showing a cross-section of the undeformed portion of the rib profile.
Figure 4:
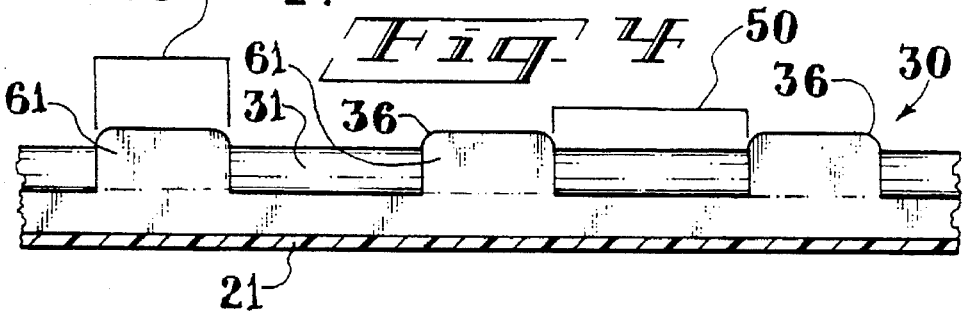
FIG. 4 is a side view of a deformed rib profile of a closure member of the present invention.
Figure 6:
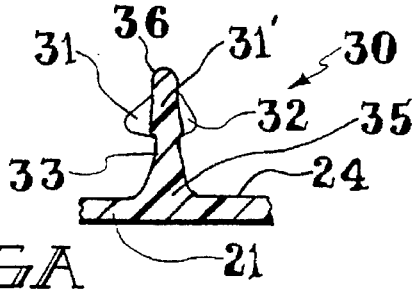
FIG. 6 is a cross-sectional view taken along line 6—6 of FIG. 5.

In the deformation process, the ears 32 of the head 31 are compressed simultaneously from both sides of head 31 in a transverse or lateral direction inwardly into the head body 31 forcing the flow of material from the ear portion 32 upwardly toward the top portion of the head 31. Thus, the top head portion 36 in the deformed segments 60 of the male profile 30 are raised to a higher elevation than the undeformed segments 50 as shown in FIGS. 2 to 4 to form a raised portion defining a rib or ridge 36 (viewed in FIG. 4) or hump 36 (viewed in FIG. 6). Ideally, the ears 32 are compressed flush with the stem portion 33 but typically, a small portion of ears 32 may remain due to the imperfections of the mechanical deformation process. Preferably, the ears 32 are substantially eliminated in the deformed segments 60.

While it is conceivable that the indentions or recesses formed after deformation can be made on only one side of the rib element 30, it is preferred to form the deformations on both sides of the rib member 30 to form indentions in mirror image on both sides of the rib profile 30.

As aforementioned, when the deformations are made on both sides of the rib 30, this causes the ears 32 of the rib to be squeezed inwardly which in turn simultaneously moves the head upwardly to form the elongated shank-shaped member with head portion 36. The head portions 31' and 36 are about the same width as the stem portion 33 and thus segment 60 comprising the entire elongated shank-shaped member is narrower in width than the undeformed segments 50. The deformation process creates two identical indentions in mirror image on both sides of the rib 30.

The indentions of the present invention are of a shape and structure to provide an intermittent clicking sensation as the rib and groove profiles are pressed into interlocking relation along the length thereof which is measured in terms of palmograph value and to provide a lowered closing force for ease of closing the reclosable closure member. It is also important to provide a depth of deformation to form indentions sufficient to lower the closing force and increase palmograph value and to form the raised ridge portions 36. Increased palmograph value is a measure of the vibrating feel which is the confirmation by sound and/or touch to the user that the closure member is closed. It is of course to be understood that the intermittent clicking sensation will also be provided in opening the closure member. However, the importance of this feature is in the closing of the closure member so that the user will be insured that the closure member is closed.

Figure 5:
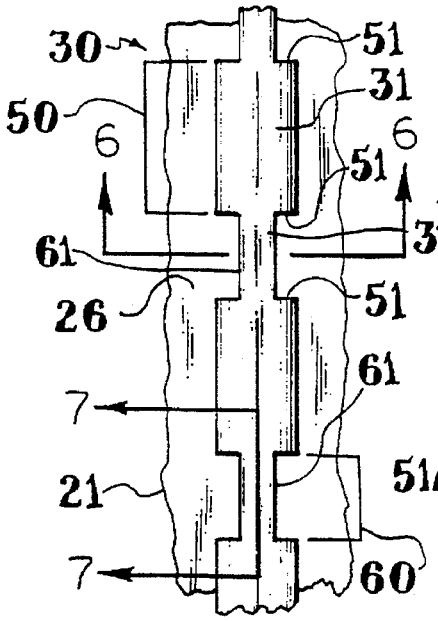
FIG. 5 is a top view of FIG. 4.
Figure 5A:
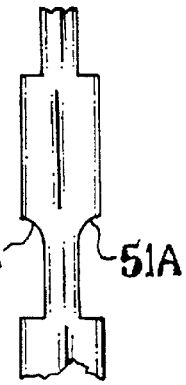
FIG. 5A is a top view of another closure member having indentions with uni-directional feel.
Figure 7:
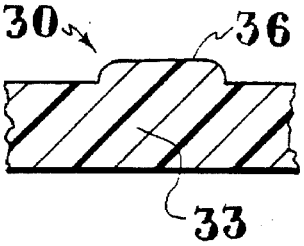
FIG. 7 is a cross-sectional view taken along line 7—7 of FIG. 5.
Figure 4:
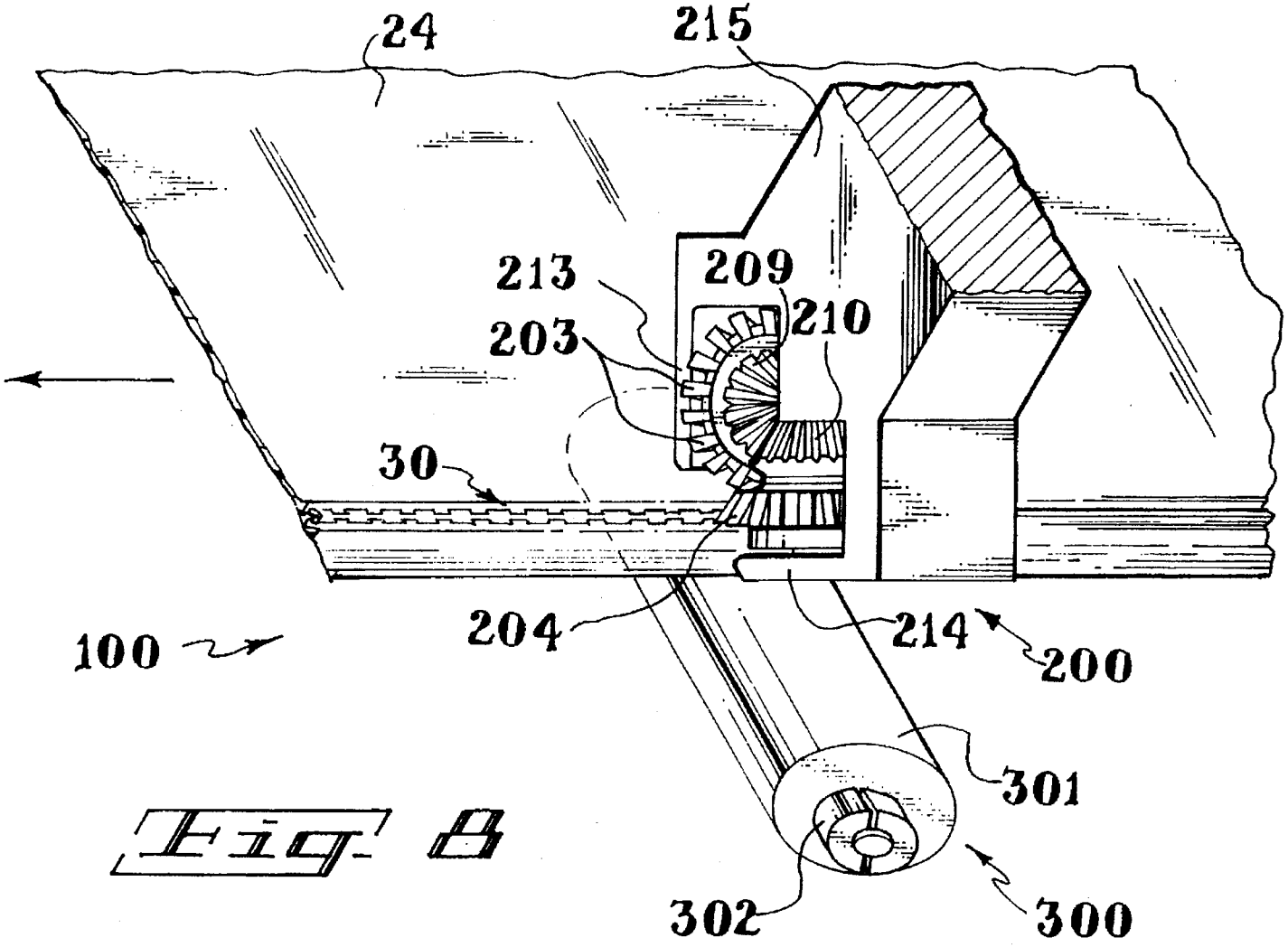
Figure 9:
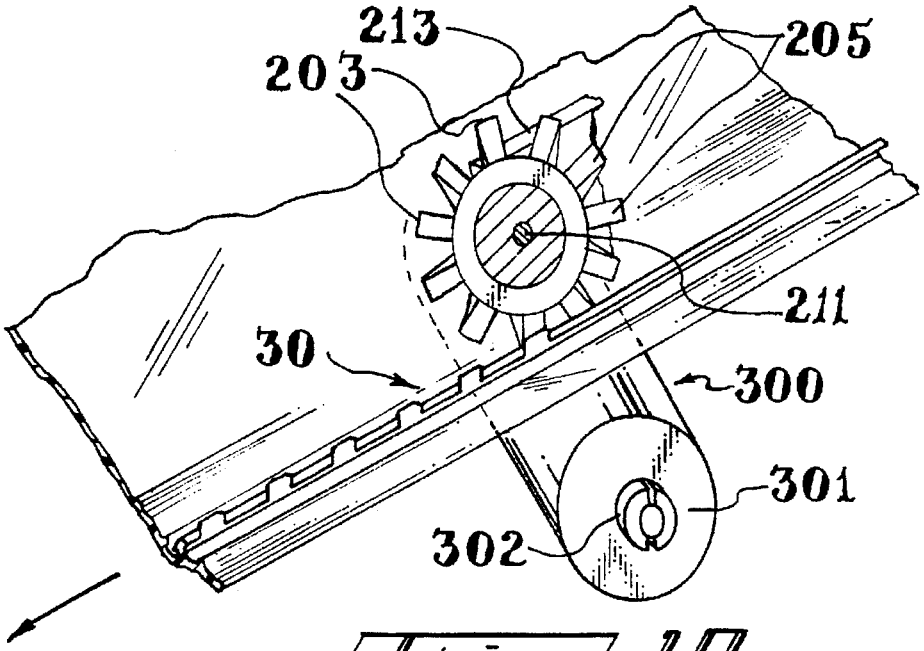
FIG. 9 is an enlarged partly cross-sectional, partly broken away, view of the deforming apparatus of FIG. 8 showing teeth elements of a rotary member contacting a closure member rib profile.

To obtain the advantages with regard to minimizing closure force while maintaining tactility, the indentions or recesses of segment 60 on each side of the rib member 30 comprises 90 degree right angle corners formed by planar walls 51 and 61. As the corners, where the walls 51 and 61 meet, become rounded, forming a semi-circle shape (as viewed from the top and shown in FIG. 5A), the clicking sensation as the rib and groove profiles are pressed together into interlocking relation is substantially reduced or eliminated when the closure sense touches the curved portion, i.e., the palmograph value is decreased. In FIG. 5A, one of the square corners of the indention is rounded, thus providing a one-directional tactility sensation.

The closing force of the closure member 10 of the present invention is generally less than about 0.23 pounds force, preferably from about 0.16 to about 0.22 pounds force and more preferably from about 0.18 to about 0.2 pounds force. The palmograph value of the closure member 10 of the present invention is generally as great as possible, preferably greater than about 0.17 pounds force, more preferably greater than about 0.24 pounds force, and most preferably greater than about 0.3 pounds force.

Another embodiment of a closure member of the present invention utilizes a rib profile member as shown in FIGS. 14–16. A closure member embodiment using the rib profile of FIGS. 14–16 comprises opposing longitudinally extending interlockable rib profile 30 and groove profile 40 essentially identical to closure member 10 except that a plurality of tactility protrusion members 37 provided at spaced intervals are incorporated in the outer surface 25 of the sidewall member 21 to which the rib profile member 30 is attached. Viewing FIGS. 14–16, the protrusions or bumps 37 are provided near the base 35 of the stem 33 on one or both sides of the stem 33 of the rib profile 30 intermittently and longitudinally extending along profile 30. The protrusions 37 are formed by creating indentions or recesses 38 in top surface 24 near the base of stem 33 thereby pushing out the plastic material toward the outer surface of sidewall 21. The deforming apparatus 100 described below is used to provide the indentions 38 by positioning the apparatus 100 to a depth "d2" as described below.

The deformations formed in segment 60 and the bumps 37 are preferably synchronized to enhance the tactility or feel as the closure 10 is being closed and the bumps 37 further advantageously provide a finger guide closure for the user of the bag 20.

Closure members of the present invention preferably are substantially leakproof. For example, surfaces of the interlockable rib and groove profiles preferably form a contiguous or snug fit with each other along the closure member.

Closure members of the present invention may have either or both of the closure member profiles comprised in whole or in part of a "colored" thermoplastic material. "Colored" means that the thermoplastic may be tinted transparent, tinted translucent, or tinted opaque relative to the transparent look or lack of tint or color normally associated with virgin thermoplastic materials.

Closure members according to the present invention may have opposing profiles wherein each profile is transparent or translucent and of a different color. The opposing profiles may be interlocked to produce a predetermined third color. For instance, a profile having a blue color and an opposing profile having a yellow profile could be interlocked to impart a green color.

As an illustration of another embodiment of the closure member 10 of the present invention, one or both of the closure member profiles may have a regime of colored thermoplastic material extending longitudinally through the profiles sandwiched between noncolored thermoplastic material such as in rib profile 30 of closure member 10 of FIG. 17. The regime of colored thermoplastic material may further be situated in the profile such that it is carried by a portion or portions of the profile interrupted by indentions within and along it. Since the affected portions carrying the colored thermoplastic material extend continually or intermittently but not continuously along the profile, a colored dashed line or dashed strip is observed. The segments along the profile not having the affected portions are of a different shape than those that do.

FIG. 17 illustrates closure member 10 of the present invention with head 31 and ribs 34 of rib profile 30 having a regime of colored thermoplastic material 39 extending continually and longitudinally through head 31 and continuously and longitudinally through ribs 34. In another embodiment (not shown), the head 31' and/or ridge portion 36 may also include a colored regime if desired. Regime 39 is positioned in profile 30 such that it is carried by a portion or portions (head 31) of profile 30 interrupted by indentions within and along profile 30. A distinct alternation of color akin to a dashed line along head 31 is imparted.

When profiles 30 and 40 are interlocked while viewing through profile 30, a color change may be observed at the portion of groove profile 40 where groove arms 41 contact with the remainder of profile 30 if the virgin, untinted thermoplastic material comprising profile 30 is thick enough at that portion to be translucent instead of transparent but not thick enough to be opaque. If that portion is translucent when rib profile 30 having colored thermoplastic material in head 31 is brought into interlockment with groove profile 40, the color of head 31 is readily visible through the translucent portion of profile 30 and imparts the effect of a color change.

While not bound by any particular theory, it is believed that the means by which the closure members of the present invention create an audible clicking sound and/or impart a vibratory or bumpy feel perceptible to the touch upon interlockment of the closure member profiles is the presence of an intermittent discontinuity in structure along portions of either or both of the profiles. The discontinuity in structure is typically in those portions of the opposing profiles which contact each other upon interlockment of the closure member. In the case of a rib and groove profile, for example, as the closure 10 is interlocked by hand for example between the thumb and index finger, the audible clicking sound and the vibratory or bumpy feel are believed to result from hooks 42 of groove arms 41 contacting planar surfaces 51 of head 31 as rib and groove profiles 30 and 40 are interlocked from one end of closure member 10 to the other or from one point along closure member 10 to another point along the same.

The features of audible clicking and vibratory or bumpy feel of closure members of the present invention are separable. A closure member may impart a vibratory or bumpy feel which is tactile or perceptible to the touch without imparting an audible clicking sound and be within the scope of the present invention.

Closure members of the present invention preferably have intermittent or alternating segments of two different shapes. The segments of differing shape may be of equal or unequal length. Preferably, the segments having indentions within them are of lesser relative length than those segments not having indentions within them so as to minimize the likelihood or incidence of liquid leakage through the interlocked closure member and to to maximize burst strength of the bag. The segments having indentions within them have an incidence along a profile preferably of from 1 to 8, more preferably 3 to 6, and most preferably 4 per inch of profile. The length of each segment having an indention within is preferably from about 1/32nd to about 3/16th and most preferably about 1/8th of an inch.

The present invention has been described above with reference to rib and groove profiles. However, the terms "rib profile" and "groove profile" used herein are used as terms of convenience to describe opposing interlockable male and female closure member profiles, and are not to be construed as limiting. It is to be understood that other closure member structures or fastener structures having reclosable interlocking profile elements of other configurations may be utilized so long as at least one of the profile elements is deformed at spaced intervals along the length thereof to provide an intermittent clicking sensation as the profile elements are pressed into interlocking relation along the length thereof to close the reclosable fastener thereby providing confirmation by sound and/or feel to the user that the fastener is closed. For example, the hook-shaped profiles configuration shown in U.S. Pat. No. 4,561,109 may be deformed in accordance with the present invention.

The art is replete with closure members and reclosable fasteners of different structures and configurations adaptable to thermoplastic bags. Examples of this art are seen in U.S. Pat. Nos. 4,363,345, 4,561,109, and 4,528,224 incorporated herein by reference. Prior art closure member structures can readily be modified in accordance with the present invention to form a closure member having the desired audible clicking and/or vibratory and bumpy feel which is tactile and perceptible to the touch.

Shown in FIGS. 18–21 are various other embodiments of the present invention of different profile configurations having a raised portion substantially the same or identical to the raised portion 36 as described above with reference to the rib profile 30. For example, in FIG. 18 there is shown rib and groove profiles, 30 and 40, respectively, having raised portions 36 and **42*a*, respectively; and rib members 34 having raised portions 34*a*. Any one or more of the members 31, 34 or 42 may have intermittent deformed portions, 34*a* or 42*a* which are substantially the same as raised portion 36**, if desired.

Figure 19:
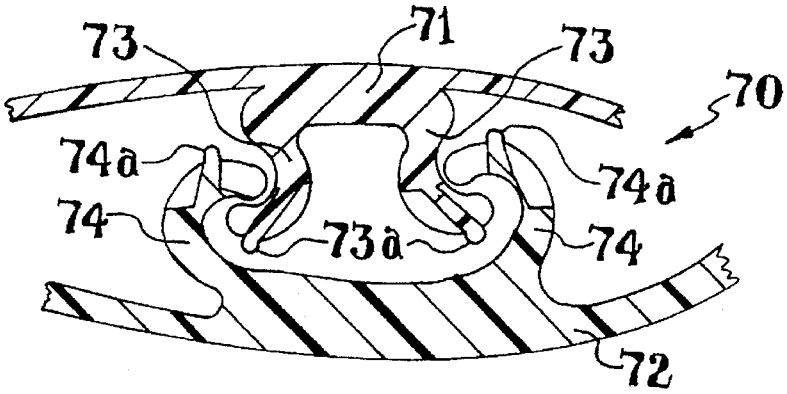

FIG. 19 shows a closure member 70 with hook-shaped profiles 71 and 72. Profile 71 has hook members 73, while profile 72 has hook members 74. Hook members 73 and 74 have raised portions **73*a* and 74*a*, respectively. Any one or more of the hook members 73 or 74 may have intermittent deformed portions 73*a* or 74*a*, which are substantially the same as raised portion 36**, if desired.

Figure 20:
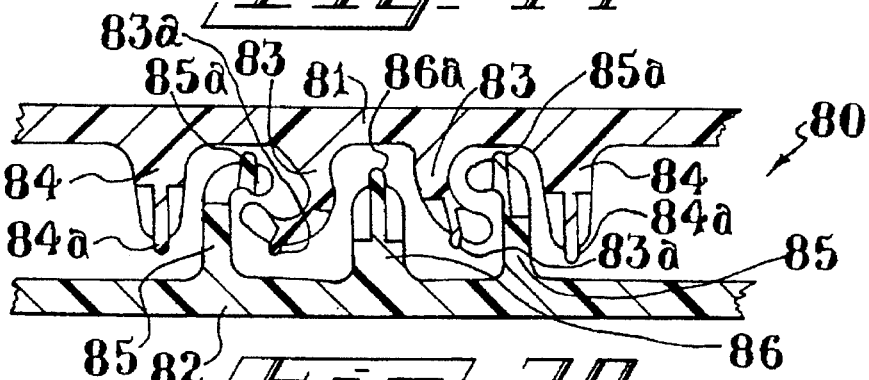

FIG. 20 shows a closure member 80 with profile members 81 and 82. Profile 81 has hook members 83 and rib member 84, while profile 82 has hook member 85 and rib member 86. Any one or more of the members 83–86 may have intermittent deformed portions **83*a*, 84*a*, 85*a* or 86*a*, which are substantially the same as raised portion 36**, if desired.

Figure 21:
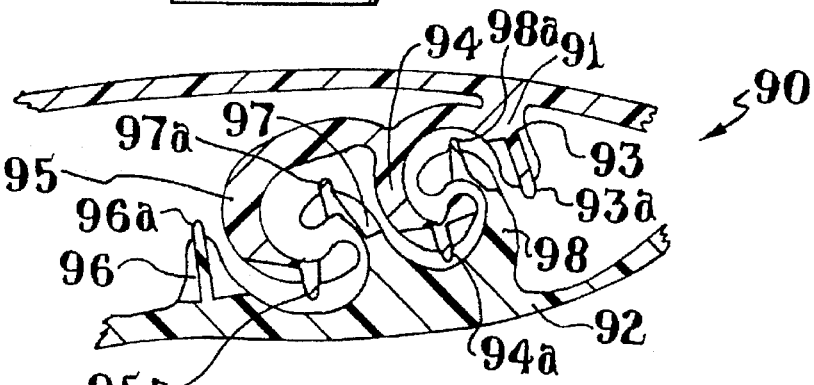

FIG. 21 shows a closure 90 with profile members 91 and 92. Profile 91 includes rib member 93 and hook members 94 and 95. Profile 92 includes rib member 96 and hook members 97 and 98. Any one or more of the members 93–98 may have intermittent deformed portions **93*a*, 94*a*, 95*a*, 96*a*, 97*a* or 98*a*, which are substantially the same as raised portion 36**, if desired.

The process of making the closure member of the present invention includes an extrusion step. Closure member profiles, for example rib or groove profiles, of closure members of the present invention may be formed by direct extrusion of the profiles with at least one of the profiles having indentions within and along its length, but preferably the profiles are formed by directly extruding the profiles without indentions within and along its length, and subsequently imparting indentions within and along the profile by deforming portions of the profile. Alternately, the closure member profiles may be described as being formed by direct extrusion of the profiles with at least one of the profiles, for example a rib profile defining at least two different segments of different shapes along its length, but preferably the profiles are formed by directly extruding the profiles without segments of different shapes, and subsequently deforming one of the profiles to define at least two different segments of different shapes along its length by deforming portions of the profile.

An apparatus according to the present invention for making a longitudinally extending closure member for a thermoplastic reclosable bag, comprises a means for providing a first closure member profile having a longitudinally extending part interlockable with a longitudinally extending opposing second closure member profile, a means for aligning the first profile in a fixed position in a deforming means, a means for deforming the part to form indentions therein intermittently along its length such that when the first and second profiles are interlocked the indentions within the part are substantially free of interdigitation with portions of the second profile, and a means for providing the second closure member profile.

The means for providing the first and second closure member profiles may comprise an extruder (not shown) and a die means (not shown) to shape the profile as is commonly known in the art. The means for providing the first and second closure member profiles may also comprise a means for advancing the profiles.

The means for deforming portions of the part of at least one of the profiles, for example a rib profile, renders the part and the profile structurally discontinuous along their length and forms first and second segments along the length of the part wherein the first and second segments have different shapes. Means for deforming portions of the part forms a profile configuration wherein the first and second segments alternate along the length of the profile.

As an illustration, a preferred part for a first closure member rib profile takes the form of a bulbous head. A preferred means for providing the rib profile comprises providing a first closure member rib profile having a longitudinally extending bulbous head which is interlockable with an opposing second closure member groove profile or part thereof. A preferred means for deforming portions of the part comprises deforming portions of the bulbous head. A preferred means for deforming portions of the bulbous head may form intermittent and preferably alternating first and second segments along the length of the bulbous head wherein the first segment is bulbous and the second segment is generally elongated shank-shaped.

A means for interlocking the opposing first and second profiles after the profiles are formed may be used. Preferably, the interlocking means takes the form of juxtapositioned closing rollers (not shown) as commonly known in the art. The opposing profiles are interlocked as they pass between the closing rollers. The interlocking means will interlock the opposing profiles such that the indentions, for example, within the part of the rib profile are substantially free of interdigitation with portions of the second groove profile. Preferably, the interlocking means interlocks the first rib profile with a second closure member groove profile. The second closure member, such as the groove profile, may be longitudinally extending and essentially continuous in structure in that does not define projections extending therefrom or indentions therein along its length. However, it is within the scope of the present invention to provide indentions to the groove profile as described above.

One embodiment of a means of deforming a rib profile of the present invention is shown in FIGS. 8–11, and is referred to hereafter as deforming apparatus 100. Deforming apparatus 100 intermittently deforms a part of a rib profile 30 (shown in FIGS. 2–8), interlockable with an opposing groove profile 40. Rib profile 30 may have ribs 34 extending therefrom on either side of head 31. Deforming apparatus 100 for deforming the head 31 of the rib profile comprises a deforming head apparatus 200 and an anvil roll apparatus 300. Any conventional means for positioning and aligning the rib profile between the deforming head apparatus 200 and the anvil roll apparatus 300 can be used.

The anvil roll apparatus 300 includes an anvil roll 301 rotatable mounted on a shaft 302. The rib profile with film web contacts the surface of the anvil roll 301 and rolls off the anvil roll 301 as the profile passes between the deforming head apparatus 200 and anvil roll apparatus 300.

The deforming head apparatus 200 used for deforming the head of the rib profile 30 comprises a means for intermittently laterally deforming the head 31 of the rib profile 30. The lateral deforming means comprises first and second rotary members 201 and 202, respectively. First and second rotary members 201 and 202 each have a plurality of radially situated, outwardly-projecting teeth 203 and 204, respectively.

Preferably, the teeth have generally planar front portions 205 and 206, respectively, for contacting the sides of head 31. More preferably, the planar surface portions 205 and 206 contain parallel ridge members near the side edges of the front portions. FIG. 11 shows a tooth member 206 with the ridges **206*a*. Preferably, a tooth member 205 with ridges (not shown), identical to tooth member 206, would be positioned in minor image to tooth 206 to form indentions in rib profile 30. The ridge members 206*a* ensure that the indentions in segment 60 will form square corners, i.e., that the planar surfaces 51 and 61 will be at right angles to each other. Rotary members 201 and 202 are positioned with respect to each other so that teeth 203 and 204 of each member are spaced apart, forming a gap "G" for receiving the rib profile 30 and are aligned in face-to-face synchronization as members 201 and 202 are each rotated in the same direction. Members 201 and 202 are further positioned such that the front portions 205 and 206 of teeth 203 and 204, respectively, area a depth "d1" and contact and straddle the lateral portions or sides of head 31 of passing rib profile 30. The teeth do not excise the head 31, but instead deform the head 31 by squeezing or compressing the head 31 which in turn forces plastic material upwardly to form ridge 36. Teeth 203 and 204 are spaced about rotary members 201 and 202 in a pitch corresponding to the desired frequency of indentions within head 31. Protrusions or bumps 37 in sidewall 21 (FIGS. 14–16) may be produced by positioning the apparatus 200 such the teeth 203 and 204 contact the surface 24 of sidewall 21 at a depth of "d2" to form indentions 38. The bumps 37 advantageously provide a finger guide means to the user of the bag 20** by providing a greater tactile sensation when closing the bag.

With reference to FIG. 8–11 again, rotary members 201 and 202 are situated spaced apart and adjacent the anvil roll member 301. Shim members 207 and 208 are used to change the gap "G" as desired. Gears 209 and 210 are used to synchronize the movement of the rotary members 201 and 202. The rotary members 201 and 202 are mounted on shaft members 211 and 212 to allow the rotary members to rotate. The rotary members 201 and 202 are driven by the motion of the rib profile passing through the gap "G". Optionally, a heating element or device may be used to provide heat to the rotary members 201 and 202 to assist in providing the indentions to the rib profile 30. Alternatively, the rib profile 30 may be preheated or substantially simultaneously heated as it passes the apparatus 100 to assist in deforming the profile. The gears, rotary members, shims, and shafts are held by arms 213 and 214 integral with body 215 of the apparatus 200.

As aforementioned, a process according to the present invention for making a longitudinally extending closure member for a thermoplastic reclosable bag comprises providing a first closure member profile having a longitudinally extending part interlockable with an opposing second profile, deforming portions of the part to form indentions therein intermittently along its length, providing a longitudinally extending second closure member profile, and interlocking the first and second profiles such that the indentions within the part are substantially free of interdigitation with portions of the second profile. Either or both of the closure member profiles may be provided by extrusion of thermoplastic material and shaping into the desired profile configuration utilizing a die as is common in the art. Preferably, the first profile is interlocked with a second closure member profile which may be longitudinally extending and essentially continuous in structure.

Deforming portions of the part renders the part structurally discontinuous along its length and forms the first and second segments along the length of the part wherein the first and second segments are different in shape. Preferably, deforming portions of the part forms a profile configuration wherein the first and second segments alternate along the length of the profile. A preferred part for the first closure member profile takes the form of a bulbous head. Providing the first closure member profile preferably comprises providing a first closure member profile having a longitudinally extending bulbous head which is interlockable with the opposing closure member profile. Deforming portions of the head may form intermittent and preferably alternating first and second segments along the length of the bulbous head wherein the first segment is bulbous and the second segment is generally elongated shank-shaped.

As an illustration, in deforming head 31 of a rib profile 30 according to the process of the present invention, the rib profile 30 passes and proceeds between rotary members 201 and 202 to form rib profile 30 having undeformed and deformed segments 50 and 60 respectively. Teeth 203 and 204 revolve on shaft 211 and 212 which are at 45° angles but position the rotary members at a 90° angle at the point of the gap "G". At the gap "G", the teeth 203 and 204 contact and deform the generally bulbous head 31 of profile 30 intermittently along its length to form indentions in a lateral direction therein manifested in generally elongated shank-shaped member in segments 60. The rotary members 201 and 202 on shafts 211 and 212 are positioned in 45° angles to avoid damaging the rib members 34. In an embodiment without ribs 34, the shafts 211 and 212 may be positioned at a 90° angle to position the rotary members 201 and 202 horizontally and perpendicular to the head 31 of profile 30. Alternatively, in an embodiment with the ribs 34, the ribs may be deflected out of the way as described in FIG. 22 of the '584 patent. The front portions 205 and 206 of teeth 203 and 204, respectively, preferably contact and deform head 31 in the upper lateral portions of head 31 to form the desired elongated shank-shaped member in segments 60 found in closure member profile 30. Rib profile 30 may then subsequently be interlocked with an opposing second closure member groove profile 40 to form closure member 10.

EXAMPLE 1 AND COMPARATIVE EXAMPLE A AND B

A palmograph unit shown and described in U.S. Pat. No. 5,154,086 (the '086 patent), incorporated herein by reference, was used in this example to determine the degree of vibratory feel ("palmograph value") and the average closing force of (1) a GRIPPER ZIPPER™ closure on a ZIPLOC™ brand storage size plastic bag (Comparative Example A) commercially available from DowBrands L.P. and generally illustrated in Figure A, (2) a zipper closure member having the indentions as shown in FIG. 5A, and (3) a zipper closure member of the present invention (Example 1). The zippers tested in this example were made on a cast film extrusion line producing a cast film web with integrally applied profiles. The rib profile of Example 1 was formed using the apparatus of FIGS. 8–10. The measurements obtained with the palmograph unit are off-line.

Generally, the palmograph unit performs three main functions: (1) closing the zipper, (2) monitoring the force required to close the zipper and the oscillations in closing force, and (3) analyzing the force required to close the zipper. The general procedure for obtaining the measurements in this example is as follows:

A zipper of a bag to be tested is excised from the bag and is partially zipped beginning at one end of the zipper. The zipper is clamped at either end under tension sufficient to maintain alignment of the male and female profiles as they are progressively interlocked. A pair of mechanical "fingers" are positioned on opposite sides of the male and female profiles to force the male and female profiles into interlocking engagement as the zipper is drawn through a small gap defined between the two mechanical fingers, beginning adjacent the already-zipped portion of the zipper.

A load cell operatively associated with the two opposing mechanical fingers continuously and instantaneously measures the compressive force placed on the fingers by the zipper as it passes through the gap, and this force is contemporaneously graphed, displayed, recorded and/or analyzed as on a conventional strip chart recorder or through an associated computer. An indication of the necessary closure force of zipping the zipper is provided over the length of the zipper, as well as an indication of the variations in the closure force and thus of the "tactility" of the zipper.

A zipper of Comparative Examples A and B, and a zipper produced in accordance with the present invention (Example 1) were passed through the palmograph unit using the general procedure described above.

The forces sensed by the load cell in the palmograph unit were recorded. Comparative Example A and Example 1 were graphed as illustrated in FIGS. 12 and 13, respectively. The "peaks" and "valleys" shown in FIGS. 12 and 13 represent the alternately high and low closure forces required to interlock the deformed and undeformed segments of the male profile 30 with corresponding portions of the female profile 40. The magnitude of the difference between the peaks and valleys is an indication of the tactility of the zipper 10, or of the degree of bumpiness perceived by a consumer's fingers as the consumer's fingers slide along the zipper 10 and interlock the male and female profiles 30 and 40, respectively. The average amplitude of the trace is indicative of the palmograph valve and the average midpoint of the amplitude is indicative of average closuring force required of the consumer to zip the zipper 10.

The results of the measurements of this example are tabulated in Table I below:

TABLE I

| EXAMPLE | PALMOGRAPH VALUE | AVERAGE CLOSING FORCE |
|---|---|---|
| Comparative Example A | 0.23 | 0.30 |
| Comparative Example B | 0.13 | 0.25 |
| Example 1 | 0.23 | 0.18 |

Both the degree of bumpiness or tactility of a zipper and the average closure force required to zip a zipper will normally be important considerations in the proper design and manufacture of a zipper. In practical terms, a commercially acceptable zipper will be designed to possess a certain degree of bumpiness or greater and a relatively low average closure force.

The results in Table I show that there is a significant decrease in average closure force in the zipper structure of Example 1 from Comparative Example A while maintaining palmograph value. In Comparative Example B there is a loss of vibratory feel which is undesired. The novel structure of the closure member of the present invention advantageously provides a significant unexpected improvement over the commercially available zippers.

While several of the embodiments of the invention have been shown with regard to specific details in designs for closure member profiles and apparatuses for making same, it will be appreciated that depending upon the closure member profile and apparatus designs and the manufacturers' desires, the invention may be modified by various changes while still being fairly within the scope of the general teachings and principles hereof.

What is claimed is:

1. A closure member for a reclosable thermoplastic bag, comprising two opposing, longitudinally extending interlockable rib and groove profiles, the rib profile having a longitudinally extending part interlockable with the opposing groove profile, the part defining at least first and second segments therealong, the first and second segments being different in shape, the part being substantially free of interdigitation with the opposing groove profile, the part being a longitudinally extending head, the head defining the first and second segments therealong, and wherein the first segments define a longitudinally extending head bulbous in shape and the second segments define a generally elongated shank-shaped longitudinally extending head having a raised ridge portion higher than the surface of the bulbous head of the first segment.

2. The closure member of claim 1 including protrusions at an outer surface opposite the base portion of rib profile to provide a textured surface for tactility.

3. The closure member according to claim 1, wherein the first and second segments alternate therealong.

4. The closure member according to claim 1, wherein a portion of the part carries a regime of colored thermoplastic material continually and longitudinally therealong.

5. The closure member according to claim 1, wherein either or both of the profiles are comprised of a colored thermoplastic material.

6. A thermoplastic reclosable bag, the bag having the closure member of claim 1 about the opening thereof.

7. A closure member for a reclosable thermoplastic bag, comprising: two opposing longitudinally extending interlockable profile elements, at least one of the profile elements having alternating deformed segments and undeformed segments along the length of the profile element, the deformed segments being narrower and taller than the undeformed segments, the deformed segments and the undeformed segments forming about right angles where they meet.

8. The closure member of claim 7 wherein the undeformed segments are adapted to interlock with the opposing profile.

9. The closure member of claim 8, wherein at least one of the profiles has a rib profile.

10. The closure member of claim 8 wherein at least one of the profiles has a groove profile.

11. The closure member of claim 8 wherein either or both of the profiles comprise a colored thermoplastic material.

12. The closure member of claim 8 wherein the profiles impart an audible clicking sound when the profiles are interlocked.

13. A thermoplastic reclosable bag having the closure member of claim 8 about an opening thereof.

* * * * *